US006631983B2

(12) United States Patent
Romano, Jr. et al.

(10) Patent No.: US 6,631,983 B2
(45) Date of Patent: Oct. 14, 2003

(54) INK RECIRCULATION SYSTEM FOR INK JET PRINTERS

(75) Inventors: Charles E. Romano, Jr., Rochester, NY (US); David P. Trauernicht, Rochester, NY (US); Richard C. VanHanehem, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,229

(22) Filed: Dec. 28, 2000

(65) Prior Publication Data

US 2002/0085076 A1 Jul. 4, 2002

(51) Int. Cl.[7] ..... B41J 2/18
(52) U.S. Cl. ..... 347/89
(58) Field of Search ..... 347/89, 73, 74, 347/76, 77, 82, 93

(56) References Cited

U.S. PATENT DOCUMENTS

| | | | | |
|---|---|---|---|---|
| 3,373,437 A | | 3/1968 | Sweet et al. | 347/74 |
| 3,416,153 A | | 12/1968 | Hertz et al. | 347/73 |
| 4,153,902 A | | 5/1979 | Kanayama | 347/92 |
| 4,346,387 A | | 8/1982 | Hertz | 347/75 |
| 4,403,227 A | | 9/1983 | Bertschy et al. | 347/89 |
| 4,445,124 A | * | 4/1984 | Fujii et al. | 347/89 |
| 4,555,712 A | | 11/1985 | Arway et al. | 347/7 |
| 4,786,327 A | | 11/1988 | Wenzel et al. | 106/31.32 |
| 4,802,989 A | * | 2/1989 | Haruta et al. | 210/688 |
| 5,069,718 A | | 12/1991 | Kappele | 106/31.46 |
| 5,755,861 A | | 5/1998 | Fujioka et al. | 106/31.27 |
| 6,079,821 A | | 6/2000 | Chwalek et al. | 347/82 |
| 6,554,410 B2 | * | 4/2003 | Jeanmaire et al. | 347/77 |
| 2002/0122102 A1 | * | 9/2002 | Jeanmaire et al. | 347/77 |

FOREIGN PATENT DOCUMENTS

| | | |
|---|---|---|
| JP | 56126170 | 10/1981 |
| JP | 60072739 | 4/1985 |

* cited by examiner

*Primary Examiner*—Michael Nghiem
(74) *Attorney, Agent, or Firm*—Walter S. Stevens

(57) ABSTRACT

An improved continuous ink jet printing system which continually recirculates its ink through an ion-exchange treatment is disclosed. The system includes collecting guttered ink for reconstitution and recirculation and propelling said collected and recircultating ink through an ion-exchange column and then to an ink supply reservoir and on through the nozzle bores of continuous ink jet print heads.

23 Claims, 3 Drawing Sheets

INK RECIRCULATION SYSTEM FOR INK JET PRINTERS

The present invention relates generally to the field of digitally controlled ink jet printing systems. It particularly relates to improving those systems that utilize continuous ink streams, whether the systems are heated. One such system uses heat to deflect the stream's flow between a non-print mode and a print mode.

BACKGROUND OF THE PRIOR ART

Ink jet printing is only one of many digitally controlled printing systems. Other digital printing systems include laser electrophotographic printers, LED electrophotographic printers, dot matrix impact printers, thermal paper printers, film recorders, thermal wax printers, and dye diffusion thermal transfer printers. Ink jet printers have become distinguished from the other digital printing systems because of their non-impact nature, low noise, use of plain paper, and avoidance of toner transfers and filing.

Ink jet printers can be categorized as either drop-on-demand or continuous systems. Major developments in continuous ink jet printing are as follows:

Continuous ink jet printing itself dates back to at least 1929. See U.S. Pat. No. 1,941,001, which issued to Hansell that year.

U.S. Pat. No. 3,373,437, which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153 issued to Hertz et al. in December 1968. It discloses a method of achieving variable optical density of printed spots, in continuous ink jet printing. Therein the electrostatic dispersion of a charged drop stream serves to modulate the number of droplets, which pass through a small aperture. This technique is used in ink jet printers manufactured by Iris.

U.S. Pat. No. 4,346,387 issued to Hertz in 1982, discloses a method and apparatus for controlling the electrostatic charge on droplets. The droplets are formed by the breaking up of a pressurized liquid stream, at a drop formation point located within an electrostatic charging tunnel, having an electrical field. Drop formation is effected at a point in the electric field, corresponding to whatever predetermined charge is desired. In addition to charging tunnels, deflection plates are used to actually deflect the drops.

Until recently, conventional continuous ink jet techniques all utilized, in one form or another, electrostatic charging tunnels that were placed close to the point where the drops are formed in a stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode. The electrostatically charged non-printed drops are passed from the gutter to collection bottles and recycled.

Recently, a novel continuous ink jet printer system has been developed which renders the above-described electrostatic charging tunnels unnecessary. Additionally, it serves to better separate the functions of (1) droplet formation and (2) droplet deflection. That system is disclosed in our recently issued U.S. Pat. No. 6,079,821 entitled "CONTINUOUS INK JET PRINTER WITH ASYMMETRIC HEATING DROP DEFLECTION". Therein disclosed is an apparatus for controlling ink in a continuous ink jet printer. The apparatus comprises an ink delivery channel, a source of pressurized ink in communication with the ink delivery channel, and a nozzle having a bore, which opens into the ink delivery channel, from which a continuous stream of ink flows. A droplet generator inside the nozzle causes the ink stream to break up into a plurality of droplets at a position spaced from the nozzle. The droplets are deflected by heat (rather than by electrostatic charge) in the nozzle bore, from a heater having a selectively actuated section; i.e. a section associated with only a portion of the nozzle bore. Selective actuation of a particular heater section, at a particular portion of the nozzle bore produces what has been termed an asymmetrical application of heat to the stream. Alternately actuating the sections can serve to alternate the direction in which this asymmetrical heat is applied and thereby selectively deflects the ink droplets, inter alia, between a "print" direction (onto a recording medium) and a "non-print" direction (back into a "catcher").

Referring to FIG. 1, the application of heat causes deflection of ink drops 2, the magnitude of which depends upon several factors, e.g. the geometric and thermal properties of the nozzles, the pressure applied to, and the physical, chemical and thermal properties of the ink and, the flow pattern of the ink, prior to its emission from the nozzles. Deflected drops 2 impinge on a recording medium 19 while non-deflected drops 1 are passed from a gutter 17 to collection bottles and recycled. Alternatively, non-deflected drops 1 can impinge recording medium 19 while deflected drops 2 are collected by gutter 17. U.S. Pat. No. 6,079,821 discloses a system of this type.

The application of heat (for example, the asymmetric application of heat as disclosed by U.S. Pat. No. 6,079,821, etc.), as a means for deflecting continuous ink, has a number of advantages over electrostatic deflection. Electrostatic deflection of continuous streams of ink requires ink formulations having stringent specifications with respect to electrical conductivity. For example, conductivity control components are formulated into such ink. Those components may include soluble ionizable salts such as alkali metal and alkaline earth metal halides, nitrates, thiocyanates, acetates, propionates, and amine salts. These components are unnecessary for asymmetrical heat-deflection. Also, these conductive salt components are corrosive to metal parts of the printer and therefore require inclusion of corrosion inhibitors in the ink, which, in turn, must be sufficiently compatible with other formulated ink components that control for example, viscosity, conductivity, or the like. An advantage of heat over electrostatic deflection, was thought to be that thermal inks did not require such complex formulations and conductive components.

Nevertheless, continuous ink jet systems can accumulate contamination and trace metal ions from the atmosphere and internal parts as the continuous stream of ink recirculates. Additionally, ink jet systems utilizing heat can experience a problem called kogation from insoluble inorganic salts and carbon being deposited onto the surface of the nozzles can lead to improper operation of the print head. This can occur even in electrostatic systems if heated drop generators are used. Ink jet systems can also experience corrosion of printhead components from inorganic salts. Accordingly, inks that can be even more expensive than electrostatic inks, and which have dyes that are pretreated as in U.S. Pat. No. 5,755,861 by Fujioka et al. or U.S. Pat. No. 4,786,327 by Wenzel, or U.S. Pat. No. 5,069,718 by Kappele have been contemplated. These ion-exchange treatments of dyes used in drop-on-demand ink jet systems were done prior to addition of solvent vehicles such as glycols. However, neither corrosion inhibitors nor these ion-exchange pre-treated inks having ion-exchanged dyes can provide protection from ink jet failure that stems from continuously accumulating contamination while recirculating the ink. An improvement, in continuous ink jet systems, that would inhibit contamination from recirculated ink would be a novel and welcomed advancement in the art, and has particularly surprising advantages in heated systems.

SUMMARY OF THE INVENTION

Therefore it is a principal object of the present invention to provide a method for removing trace metal ions while printing with a continuous ink jet system.

It is another object of the present invention to provide an improved continuous ink jet printer, particularly where heat is employed in the print heads, and an ink recirculation system which extends the life of the print heads.

This objective and others may be fulfilled by incorporating an ion-exchange resin bed into the ink recirculation system of a continuous ink jet printer, particularly one having a print head that uses heat (for example, asymmetric, symmetric, segmented heaters, etc.) to deflect the streams of ink droplets and/or to form the ink droplets. By continuously removing trace metal ions from the ink, and continuously reconstituting the ink, the clogging of nozzles, nozzle plate orifices, or ink channels in thermally controlled continuous ink jet print heads is substantially inhibited.

The apparatus of the invention removes dissolved, deleterious ions from the heated ink stream with an ion-exchange resin bed. Exchanging ink-deleterious ions for the ions originally bound to the resin does not hurt ink performance. That is, the latter are non-deleterious ions. The non-deleterious ion-exchange resins can be micro-reticular, macro-reticular, porous or macro-porous. Such resins can be selected from three broad types, i.e. anion exchange resins, cation exchange resins, and mixed-bed resins that can sequester both anions and cations. Both strong and weak ion-exchange resins may be useful and are well known in the art.

DETAILED DESCRIPTION OF THE INVENTION

Figure 1:
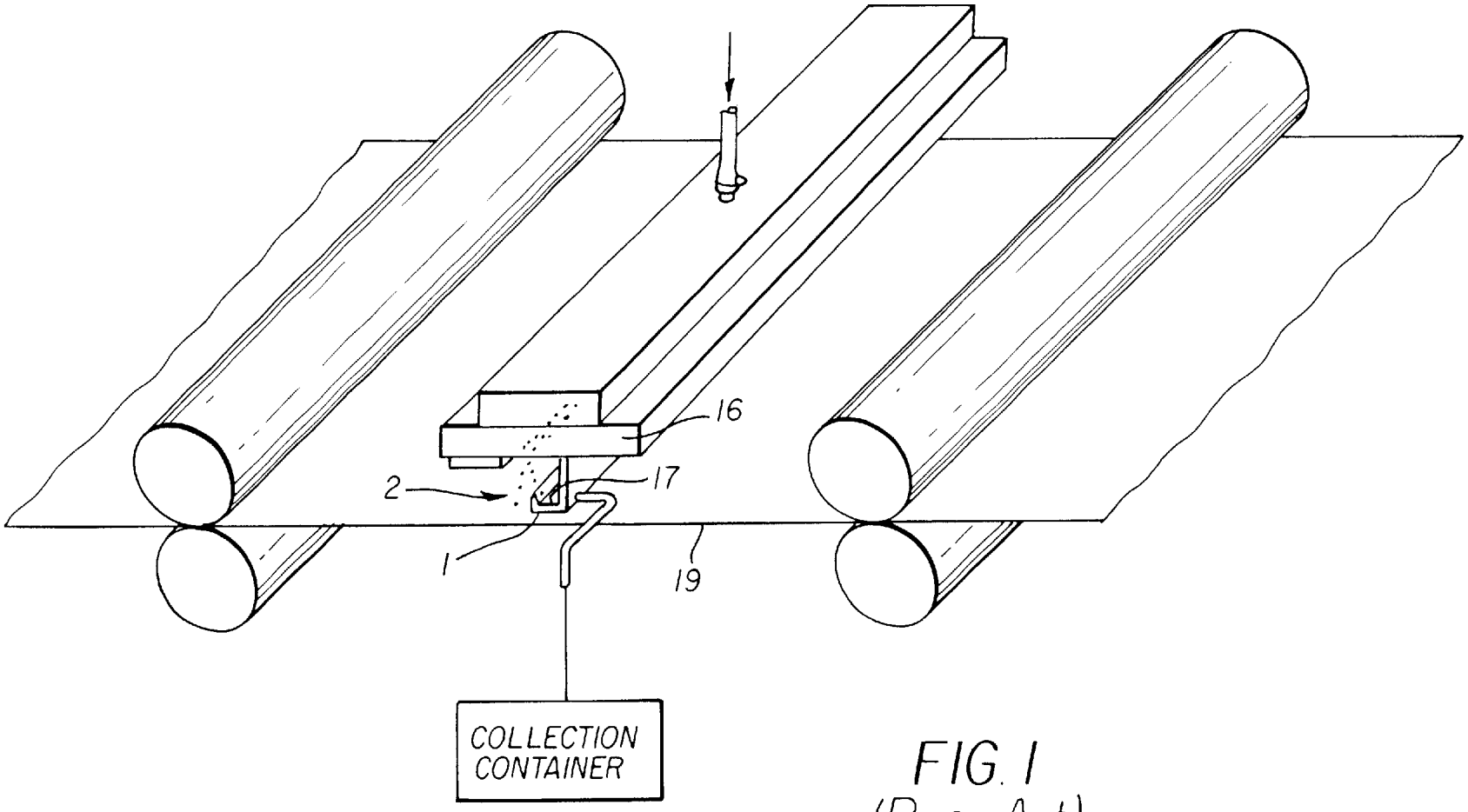
FIG. 1 (Prior Art)
FIG. 1 is a perspective view the print head, nozzle array, guttering apparatus of a continuous ink jet system, in use with a recording medium, but without showing an ink recirculation system.

The present description will be directed in particular to elements forming part of, or cooperating more directly with, apparatus in accordance with the present invention. It is to be understood that elements not specifically shown or described may take various forms well known to those skilled in the art.

These resins can be used directly if they are of the proper metal ion form (for example, sodium ion form). Alternatively, they can be converted from the free acid form to the proper metal ion form by common techniques known in the industry for performing this conversion. Typically, in this case, a quantity of free acid form of the resin would be treated with strong base of the proper cation form, for example sodium hydroxide, to generate the proper form of the resin. Subsequently, after some use and being exhausted with respect to its further ability to sequester multivalent metal cations from ink flowing through it, the resin could be regenerated for re-use by exposing it to a concentrated aqueous solution containing a salt comprised of the original cation form of the resin as, for example the chloride salt, followed by washing with clean, deionized water to remove the excess regenerating salt solution. This is a typical regeneration treatment known in the industry. It should also be noted that the desirable form of the counterion (cation) for the ink is not restricted to sodium or other alkali metal cation such as potassium, or lithium, but may also include ammonium or substituted ammonium ions, protonated primary, secondary, or tertiary amines, alkaline-earth metal ions, etc. Hence, selection or preparation of the ion exchange resin is not restricted to sodium ion.

It is understood by those familiar with the art that one cannot use a cation exchange resin (where the ions being exchanged are positively charged) to treat so-called cationic dye based inks because dye cations would quickly bind to the oppositely charged sites on the resin, saturating it, thereby rendering it useless and or plugged. Conversely, it is also understood that anion exchange resins could not be used to treat so-called anionic dye based inks for the same reason. For these same reasons, so-called mixed bed resins could not be used with ionic dye based inks. However, for inks containing neutral, uncharged dye species, any charge on the ion-exchange resin would be acceptable.

It is further understood that inks containing colored or non-colored colloids can be used in this invention. Colloids may include inorganic oxides such as silicas or aluminas, natural and man-made clays, colored pigments, polymeric particles, and colored polymeric particles. Inks containing colloids may contain charged or uncharged stabilizers or additives. Charged inks containing colloids require the same considerations regarding the choice of ion-exchange types as for charged dye based inks.

Ions that can cause problems with normal nozzle operation include multivalent metal cations such as, but not limited to, calcium, barium, zinc, strontium, magnesium, iron (III), and nickel. These are continually removed from the ink stream by the use of cation exchange resins specific to those contaminants.

Also, multivalent cations are removed from the inks by chelating resins, including but not limited to chelating resin such as Amberlite IRC-718.

The ion-exchange functionality is integrally incorporated into a resin matrix that can be of several types, including but not limited to agarose, cellulose, dextran, methacrylate, polyacrylic and polystyrene.

Commercially available cation exchange resins based on agarose include CM Sepharose CL-6B, CM Sepharose Fast Flow, SP Sepharose Fast Flow, and SP Sepharose High Performance. Examples of cation exchange resins that are based on cellulose include CM Cellulose and Cellulose Phosphate. Examples of cation exchange resins that are based nn dextran include CM Sephadex C-25, CM Sephadex C-50, SP Sephadex C-25, and SP Sephadex C-50.

Especially useful cation exchange resins that are based on either polystyrene or polyacrylic copolymer include Amberlite 200, Amberlite IR-120 Plus (H), Dowex 50WX4, Dowex HGR-W2, Dowex 650C, Dowex M31, Dowex HCR-W2 (sodium form), Dowex HCR-W2 (H form), Amberlite IRC-50, Amberlite GC-50, Amberlite DP-1, Dowex MAC-3, and Dianion WK-100.

Additional examples of commercially available chelating resins that can be used along with or in place of Amberlite IRC-718, are Dianion CR20, Dowex M-4195, and Duolite C-467. It is understood that this list is not complete and other commercially available resins of this type would also be useful.

The present description will be directed, in particular, to elements forming part of or cooperating directly with, apparatus or processes of the present invention. It is to be understood that elements not specifically shown or described may take various forms well known to those skilled in the art.

Figure 2:
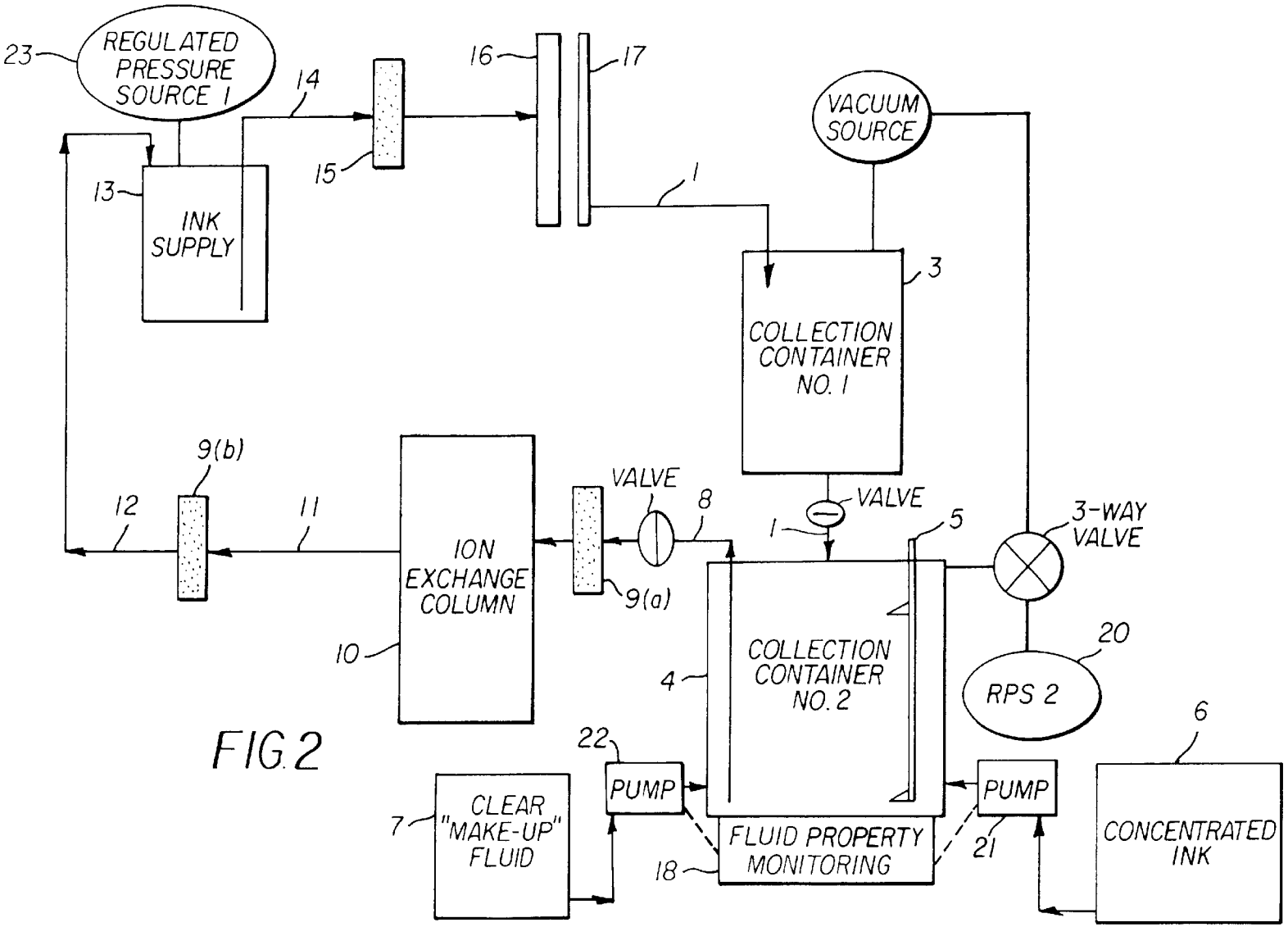
FIG. 2 is a block flow diagram of the improved continuous ink jet ink recirculation system of the present invention, having regulated pressure sources.

Referring now to FIG. 2, an ion-exchange column (10) is inserted into the continuous ink recirculation loop, downstream from collection containers (3 and 4) and upstream from the ink supply reservoir (13), as substantially shown and described. From nozzles within print head (16), continuous streams of ink are ejected and heat is applied to the ink stream, for example, by heaters within the nozzles, heaters positioned on a surface of printhead 16, etc. The ink is thermally steered into the "print-mode" direction (2) onto a print medium (19).

Alternatively, continuous streams of ink can be thermally steered in the "non-print mode" direction into a gutter (17), which empties the ink (1) preferably into a first collection container (3). The ink from said first collection container (3) empties into a second collection container (4) in controlled fashion. The properties of the unused ink (1) contained in the second collection container (4) are monitored by fluid monitoring system (18).

One ink property that may be monitored at (18) is dye concentration. The possible containers that could be needed for controlling dye concentration are shown as concentrated ink (predominantly dye) (6) and clear "make-up" fluid (predominantly solvent vehicle) (7), which are added to bottle (4) via pumps (21) and (22), respectively, if needed. Level sensor (5) is used to detect fluid levels in the container (4) so that the proper flow of ink throughout the system can be maintained. This ink monitoring and reconditioning is done to bring the ink back to the desired properties for optimal printer function. Other properties of the ink may be monitored and reconditioned as needed. Such properties include, but are not limited to, viscosity, surface tension, pH, solvent-to-cosolvent ratio, etc.

Ink mixture (8) flowing out of the collection container (4) is filtered through 9(*a*) and undesired ions and trace metal contaminants are trapped in an ion-exchange column resin bed (10) prior to flowing downstream as ink stream (11).

It is understood by those conversant in the art that the ion-exchange resin will gradually become saturated with contaminant ions as ink flows through the system. The ion-exchange resin bed in column (10) preferably allows attendant ion-exchange reactions to go to completion, although it must be kept in mind that the reactions are intrinsically reversible. Accordingly, the ion-exchange resin beds may be regenerated by either same-direction flow or reverse flow of a regenerating solution containing ions of the type that were originally on the column when it was freshly installed. This process displaces the collected, undesirable ions such as, but not limited to, multivalent metal cations such as, but not limited to, calcium, barium, zinc, strontium, magnesium, iron (III), and nickel, etc. to waste and restores the column to original condition, ready to be reused. Alternatively, the column may be emptied of its spent resin contents and new resin introduced. Normally, the regenerated resin would be washed further with ionically pure water to wash away excess regenerating ionic solution.

In accordance with the invention, the undesirable ions are replaced with the desired cationic species by ion-exchange, involving passing the ink through a strong acid ion exchange resin which as been treated with an excess of alkali metals, alkaline-earth metals, quaternary amines, protonated primary, secondary, or tertiary amines and ammonium ions.

Ion-exchange columns of the present invention are sized sufficiently to fit within the ink recirculation portion of a printer. The resin is held in a column whose shape may vary depending on application. This variation in shape of the container may extend to also to its size, and its flow characteristics. The column contains enough resin to exchange the approximate amount of adventitious contaminating materials for a reasonable period of time.

Useful shapes and designs for the ion-exchange column are numerous. There is the usual cylindrical chamber filled with ion-exchange media. One can also employ a chamber consisting of one or more tubes (0.1 to 100$\mu$ diameter, for example) with ion-exchange resin coated on the interior walls of the tubes. Flow characteristics through this tubing allows intimate contact of ink with ion-exchangeable sites on the interior tube walls, thereby removing undesirable ions.

Also one or more of the filters in the system can include an ion-exchange resin so as to consolidate the tasks which are more typically achieved by a separate filter and resin container or column.

Ion-exchange resins may be provided as thin sheets, or membranes, made strong and flexible and yet permeable. Ion-exchange membranes are often difficult to obtain with the requisite strength and flexibility while maintaining the desired permeability, however the membranes can be fabricated, if desired, to determined specifications.

Ink stream (11) is further filtered at 9(*b*) and the filtered and ion-exchange treated ink stream (12) flows into a pressure regulated (23) ink supply reservoir (13). As the printer operates, ink (14) flows from the reservoir (13) through filter (15) and into print head (16) and the entire cycle as previously described repeats itself, after ejection from the nozzles of print head (16) until the printer is turned off. It is noted that the filters 9(*a*) and 9(*b*) can also be integrally incorporated within the ion-exchange station 10.

It is to be noted that FIG. 2 illustrates a vacuum system having a source 1 (23) and a source 2 (20) where the vacuum pressure is regulated. This system pulls the guttered ink (1) into the first collection container (3) and the ink (12) from filter 9(*b*) is pulled into ink supply reservoir (13) by the regulated source (23). The only pumps are (21) and (22) for reconstituting evaporated ink base by adding concentrate 6 or clear make-up solvent (7) respectively.

Figure 3:
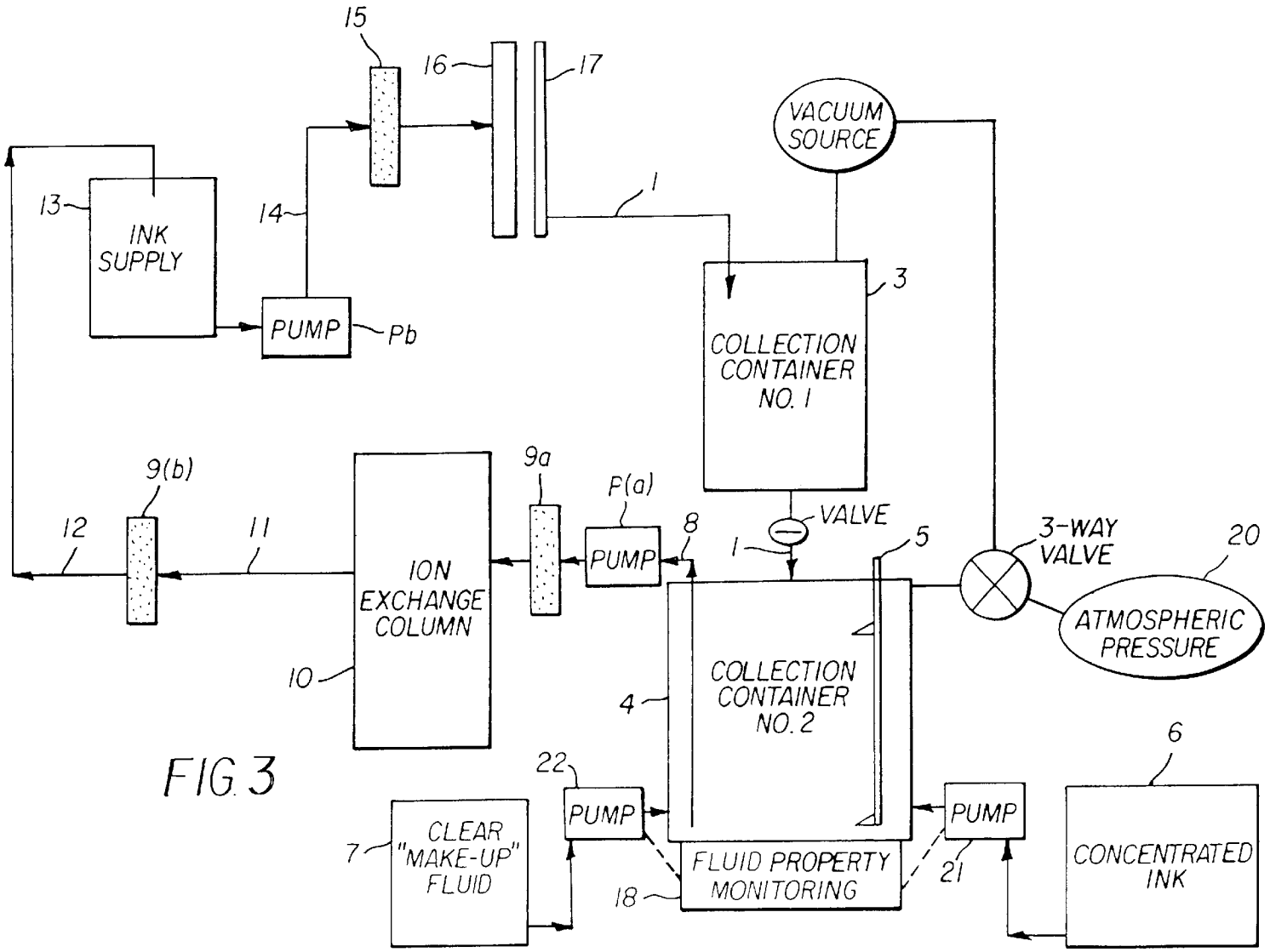
FIG. 3 is a block flow diagram of an alternative embodiment of the ink recirculation system of the present invention under atmospheric pressure and using in-line pumps.

An alternative system is shown at FIG. 3 where regulated pressure source (20) of FIG. 2 is replaced by atmospheric pressure (20) and regulated source (23) of FIG. 2 is removed. They are replaced by a pump $P_b$ just down stream from the reservoir (13), and a pump $P_a$ just up stream from filter 9(*a*). Thus the atmospheric pressure pump system of FIG. 3 alternatively powers the fluid through the recirculation process, rather than using regulated vacuum to pull the stream through the recirculation process of FIG. 2. Other alternative means for forcing the ink through the system can be any combination of externally applied pressure, or individual pumps as can be readily envisioned by those skilled in the art.

The throughput of such a recycling system must be appropriate for the continuous operation of the print head. In particular, the size and flow rate of ink through the ion-exchange column (10) must be high enough to maintain system operation. The number and size of the nozzles of a print head can vary widely depending on the application. Flow rates from as low as $1\times10^{-7}$ liters per second to as high as 0.1 liters per second can be employed while still maintaining system operation, depending on the number and size of the nozzles. Also, the number of times on average that a particular volume of ink is recirculated through the system before it is actually printed on a receiving medium can vary widely depending on the amount of printing being done. This number can vary from as little as one time to 1000 or more times. These factors must be considered when determining the quantity, and hence capacity, of ion-exchange resin.

It should be noted that although this invention has been described in terms of its most preferred embodiment which employs heat for either ink drop formation or for purposes of ink drop deflection, the invention is also intended to encompass other systems which experience kogation, corrosion, trace metal ion accumulation, etc. Additionally, the invention is also intended to encompass other systems that incorporate applying heat to ink. For example, currently pending U.S. patent application Ser. No. 09/750,946 now U.S. Pat. No. 6,554,410, entitled "PRINTHEAD HAVING GAS FLOW DROPLET SEPARATION AND METHOD OF DIVERGING INK DROPLETS" filed concurrently herewith and commonly assigned, etc.

While the foregoing description includes many details, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

Parts List

1 undeflected ink to gutter for recirculation
2 ink deflected onto print medium
3 1st collection bottle
4 2d collection bottle
5 level sensor
6 dye (ink concentrate)
7 make up fluid (solvent vehicle)
8 ink mixture (leaving 2d collection bottle)
9(*a*) filter
9(*b*) filter
10 ion-exchange column
11 ink stream leaving ion-exchange column
12 ink stream after ion-exchange treatment
13 ink supply reservoir
14 ink flow from reservoir
15 filter
16 printhead
17 gutter
18 fluid property monitor
19 recording medium
20 regulated pressure source
21 pump
22 pump
$P_a$, $P_b$ alternative pumps
23 regulated pressure source at ink supply

What is claimed is:

1. An ink recirculation system for a continuous flow ink jet printer, said ink recirculation system comprising:

an ink jet print head, including a gutter, ink flowing downstream, in a direction away from the ink jet print head gutter to a collection container for unused ink and through an ion-exchange system, then to an ink reservoir and said ink continuing on to supply ink for printing, and at least one filter stage included upstream from said ion-exchange system, said ion-exchange system being included within said filter stage, wherein the printer utilizes heat to control at least one of a formation of ink drops and a deflection of the ink drops during printing such that kogation is inhibited without having to pretreat the ink.

2. An ink recirculation system of claim 1 in which at least one filter stage is included downstream from said ion-exchange system.

3. An ink recirculation system of claim 2 in which said ion-exchange system is included within said filter stage.

4. An ink recirculation system of claim 1 in which said ink recirculation system comprises an ink monitoring and reconstitution stage disposed in fluid communication and in-line with said collection container and said ion-exchange system.

5. An ink recirculation system for a continuous flow ink jet printer, said ink recirculation system comprising:

an ink jet print head, including a gutter, ink flowing downstream, in a direction away from the ink jet print head gutter to a collection container for unused ink and through an ion-exchange system, then to an ink reservoir and said ink continuing on to supply ink for printing, at least one filter stage included downstream from said ion-exchange system and at least one filter stage included upstream from said ion-exchange system, wherein the continuous flow ink jet printer utilizes heat to control at least one of a formation of ink drops and a deflection of the ink drops during printing such that kogation is inhibited without having to pretreat the ink.

6. An ink recirculation system of claim 5 in which said ion-exchange system is included within said downstream filter stage.

7. An ink recirculation system of claim 5 in which said ion-exchange system comprises resin selected from the group consisting of anionic ion-exchange resin, cationic ion-exchange resin, and a mixture of anionic and cationic ion-exchange resins.

8. An ink recirculation system of claim 5 in which said ion-exchange system comprises one or more tubes coated internally with an anionic, cationic, or a mixture of anionic and cationic ion-exchange resin material.

9. An ink recirculation system of claim 8 wherein said ion-exchange resin is cationic and where contaminant multivalent metal cations are replaced by a preselected second cation species comprising at least one member selected from a group consisting of alkali metals, alkaline-earth metals, quaternary amines, protonated primary, secondary, or tertiary amines and ammonium ions.

10. An ink recirculation system of claim 9 wherein the contaminant multivalent metal cations are selected from the group consisting of calcium, magnesium, nickel and iron III.

11. An ink recirculation system of claim 9 wherein ions on a strong acid ion-exchange resin are substantially replaced with ions selected from the group consisting of alkali metals; alkaline-earth metals; quaternary amines; protonated primary; secondary, or tertiary amines; and ammonium ions; by passing there through a solution containing these ions.

12. An ink recirculation system of claim 5 in which said ion-exchange system is included within said upstream filter stage.

13. An ink recirculation system of claim 5 in which said ink recirculation system comprises an ink monitoring and reconstitution stage disposed in fluid communication and in-line with said collection container and said ion-exchange system.

14. An ink recirculation system for a continuous flow ink jet printer, said printer applying heat to ink, said system comprising:

a collection container for non-printed ink and an ink reservoir to supply ink for printing, said collection container being in fluid communication with said ink reservoir such that non-printed ink flows from said collection container to said ink reservoir;

an ion-exchange system disposed between said collection container and said ink reservoir, said ion-exchange system being in fluid communication with said collection container and said ink reservoir; and at least one filter stage positioned in fluid communication upstream from said ion-exchange system, wherein said filter stage is integrally incorporated within said ion-exchange system and said printer utilizes heat to control at least one of a formation of said ink into ink drops and a deflection of said ink drops during printing.

15. The ink recirculation system of claim 14 further comprising:

at least one filter stage positioned in fluid communication downstream from said ion-exchange system.

16. The ink recirculation system of claim 15, wherein said filter stage is integrally incorporated within said ion-exchange system.

17. The ink recirculation system of claim 14 further comprising:

an ink monitoring and reconstitution stage, said ink monitoring and reconstitution stage being disposed in fluid communication and in-line with said collection container and said ion-exchange system.

18. An ink recirculation system for a continuous flow ink jet printer, said printer applying heat to ink, said system comprising:

a collection container for non-printed ink and an ink reservoir to supply ink for printing, said collection container being in fluid communication with said ink reservoir such that non-printed ink flows from said collection container to said ink reservoir;

an ion-exchange system disposed between said collection container and said ink reservoir, said ion-exchange system being in fluid communication with said collection container and said ink reservoir; and at least one filter stage positioned in fluid communication downstream from said ion-exchange system, wherein said filter stage is integrally incorporated within said ion-exchange system and said printer utilizes heat to control at least one of a formation of said ink into ink drops and a deflection of said ink drops during printing.

19. The ink recirculation system of claim 18 further comprising:

at least one filter stage positioned in fluid communication upstream from said ion-exchange system.

20. The ink recirculation system of claim 19, wherein said filter stage is integrally incorporated within said ion-exchange system.

21. The ink recirculation system of claim 18 further comprising:

an ink monitoring and reconstitution stage, said ink monitoring and reconstitution stage being disposed in fluid communication and in-line with said collection container and said ion-exchange system.

22. An ink recirculation system for a continuous ink jet printer, said printer applying heat to ink, said system comprising:

a collection container for non-printed ink and an ink reservoir to supply ink for printing, said collection container being in fluid communication with said ink reservoir such that non-printed ink flows from said collection container to said ink reservoir; and an ion-exchange system disposed between said collection container and said ink reservoir, said ion-exchange system being in fluid communication with said collection container and said ink reservoir, wherein said printer utilizes heat to control at least one of a formation of said ink into ink drops and a deflection of said ink drops during printing.

23. The ink recirculation system of claim 22, further comprising:

an ink monitoring and reconstitution stage, said ink monitoring and reconstitution stage being disposed in fluid communication and in-line with said collection container and said ion-exchange system.

* * * * *